United States Patent [19]

Dürr

[11] 4,301,562

[45] Nov. 24, 1981

[54] DEVICE FOR WATER-SPORTS

[76] Inventor: Max Dürr, Breitenbacherweg 211, CH-4249 Wahlen, Switzerland

[21] Appl. No.: 934,813

[22] Filed: Aug. 18, 1978

[30] Foreign Application Priority Data

Aug. 24, 1977 [CH] Switzerland ..... 10373/77

[51] Int. Cl.[3] ..... A63C 15/03

[52] U.S. Cl. ..... 9/310 D; 9/310 A

[58] Field of Search ..... 9/310 R, 310 A, 310 AA, 9/310 B, 310 C, 310 D, 310 E, 310 F; 114/56, 61, 62, 63, 292

[56] References Cited

U.S. PATENT DOCUMENTS

| | | | |
|---|---|---|---|
| 3,034,157 | 5/1962 | Abajian | 9/310 D |
| 3,108,296 | 10/1963 | Smith | 9/310 D |
| 3,777,324 | 12/1973 | Jenkins | 9/310 D |

FOREIGN PATENT DOCUMENTS

| | | | |
|---|---|---|---|
| 2131474 | 1/1973 | Fed. Rep. of Germany | 9/310 D |
| 1371293 | 12/1964 | France | 114/61 |
| 652570 | 2/1963 | Italy | 9/310 C |

*Primary Examiner*—Sherman D. Basinger
*Attorney, Agent, or Firm*—Schiller & Pandiscio

[57] ABSTRACT

The floats (1) of the device for water-sports can be used as water-skis and have practically trapezoidal cross-section over their whole length. To achieve optimum linear running stability, especially when using the float as a water-ski, it is tapered from back to front, both in plan and side view. To achieve good tread resistance or running depth stability when walking on the water, the bottom of the float is flat or slightly concave over practically its whole length. The floats can be constructed as self supporting, foam plastic bodies with water-tight closed surface pores or as integral or multiple-piece molded hollow bodies.

1 Claim, 4 Drawing Figures

DEVICE FOR WATER-SPORTS

The present invention relates to a device for water-sports with two separate floats formed as runners which produce static buoyancy, each of these floats being provided with an attachment to take up the foot of the user, holding the foot firmly but being easily releasable.

Whilst water-skis of the normal construction only push the user against the surface of the water as long as there is a big enough buoyancy force component from a forward movement of the skis, the device for water-sports according to the present invention is a device which keeps the user above water by Archimedean buoyancy. This device for water-sports should allow the user to move on the surface of the water in the same way as a cross country skier on a more or less level area of snow. For the forward movement and to optimize the maneuverability, it is necessary to use a pushing-off device, formed similarly to ski-sticks, possibly with an effective surface which increases when pushing backwards, or a type of paddle which can also serve as a balancing means. Water-sport devices of this sort have been suggested before in unnumerable forms, whereby the floats were arranged either as air filled cavities, with or without subdivisions of space, or as foam bodies with or without outer sheathing against the entrance of water or damage. In prior art skis, the difficulties arising in use when one attempts to move forward by pushing against the skis are frequently ignored. A prior art solution to the problem is in the use of hinged members which pivot outward from the skis when the user pushes off (thereby increasing the profile of the ski in the direction of motion) and which lay flat against the skis when the skis move forward (thereby offering little running resistance). Alternatively, it was attempted to achieve the same effect by using so-called propulsion-pockets at the side of or on the bottom of the float. Such measures were however ineffective due to the practically mutually compensating forces by "filling" and "emptying" of the resistance areas. Less important for the forward movement than for the linear running stability are in addition measures on the floats which should impede the lateral drifting of the same. Floats to be attached to the foot of the user with keel and sword-shaped stabilizing means or ledge-shaped protrusions from the bottom, have proved in practice to be less suitable than those in the form of a side of a ship which put up an increased resistance to lateral drifting. Furthermore, the flatest shaped underparts prove most advantageous for the running depth stability.

However, a device for water-sports according to the present invention should not only be suitable for "walks" on still or slow-flowing waters, for which the units according to the prior art are intended, but also for "downhill runs" on rivers, and for practised sportsmen for riding the waters of torrential streams.

The invention will be fully understood from the following description read in connection with the accompanying drawings in which.

Figure 1:
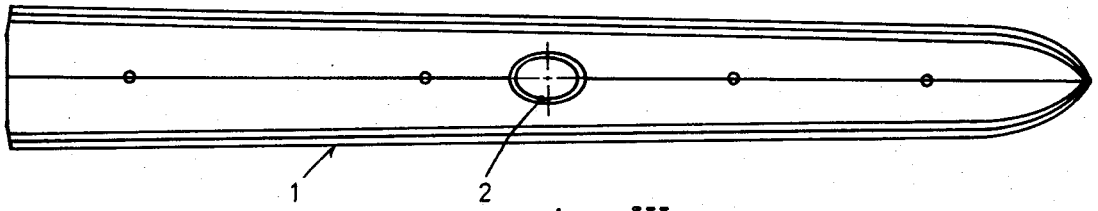
FIG. 1 shows a float in the form of a ski to be used in pairs in the device for water-sports according to the invention, in plan form.
Figure 2:
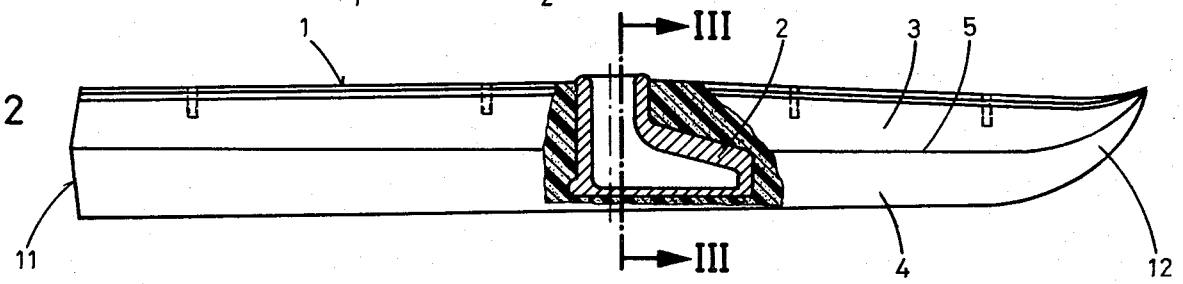
FIG. 2 shows the float according to FIG. 1 in side-view, partially in section.

FIGS. 1 and 2, show a practical form of a float 1 to be used in pairs which was achieved by constructional experiments for the device for water-sports according to the invention. The user stands with one foot in a device 2 to take up the foot, arranged for example as a shoe, which on the one hand should assure firm support for the foot, and on the other hand allows simple, fast withdrawal of the foot in case of a fall.

Figure 3:
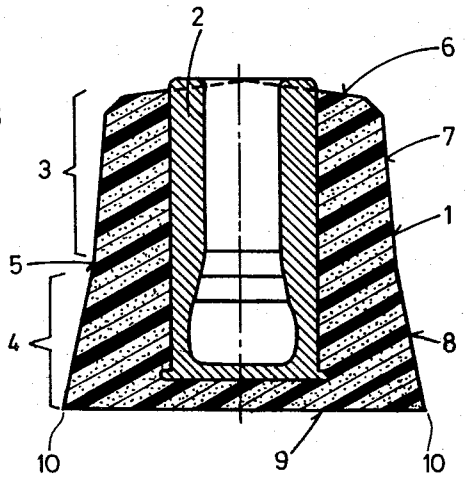
FIG. 3 shows a cross-section along line III—III in FIG. 2 and, FIG. 4 shows a cross section similar to that of FIG. 3 of an alternative embodiment of the float.

The float 1 has an appropriate cross-sectional form, the contours of which in the area of the device 2 to take up the foot are seen in FIG. 3. From this cross-section, an upper body part 3 and a lower body part 4 can be differentiated. The dividing line between these two parts is about the middle depth of submersion 5 when using the device. The upper part 3 can be provided with a sligthly convex roof part 6 for immediate flow-off of spray and has outward sloping, upper side-areas 7 which extend beyond 5 continuously, or with slightly less slope, as lower side-areas 8, to the bottom surface 9 of the float (cf. FIGS. 3 and 4). The bottom surface 9 of the float in the lower part 4 is preferably flat, as shown in FIG. 3 or, as shown for float 21 in FIG. 4, has an indentation extending along its whole length, the configuration of which can be substantially complimentary to that of the domed roof part 6 in order to be able to comfortably stack several floats.

In order for a person to be able to move with the device for water-sports according to the invention on the water like a skier the buoyancy given by the floats in a fully loaded state at standstill, when submerged a little over the line 5, is appropriately 1.2 to 1.5 times the weight of the user. This gives a buoyancy reserve necessary when "walking" on the surface of the water with alternate displacement of the weight as required for stable movement of the device for water-sports. For an adult weighing around 75 kg, a ski-length of approx. 2.10 m should be correct. Each of these floats is then given a cross-section which, also in view of an artistically acceptable design, allows it to be constructed not just as a thin-walled hollow body with minimum specific gravity, but allows materials to be used in its production which give the float the inertia necessary for good control. It is therefore possible to use quite stiff, foamed plastics for this. The use of foam plastics which produce a tight-closing, hard surface when foamed, is preferable. Such foam plastics can already be foamed at a weight of 0.070 to 0.200 kg/dm$^3$ so that a cross-section surface of 2.5 to 3.5 dm$^2$ would result in a carrying capacity of 50 to 60 kg per floating body. For a maximum submersion depth or structural height of the float of 18 to 22 cm, a maximum width of approx. 15 to 22 cm results. The ideal ratio of the weight of the float to the weight of the displaced water, relative to that of the water displaced by a fully submerged float, is between about 0.08 and 0.15. In order not to have to construct too heavy floats, it is therefore appropriate to foam the float as a hollow body when using foam plastics of higher density, i.e. over 0.15 kg/dm$^3$, or to make for example only the outer layer with foam plastics of this sort.

Figure 4:
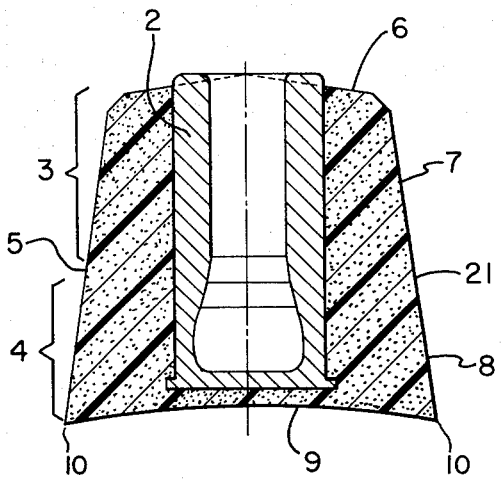

The cross-sectional form shown in FIGS. 3 and 4 is of trapezoidal form with the larger base of the trapazoid coincident with bottom surface 9, with side wall sections 7, 8 sloping similarly or differently outwards, and running straight from front to back. This shape is largely responsible for good linear running stability of the float. As noted hereinbefore, sides 7, 8 may either extend through mid-submersion line 5 in a continuous line or may make an angle with one another along line 5, the lower sides 8 having less slope than the upper sides 7. The first of these results in the trapazoidal cross-section shown in FIG. 4, while the second, illustrated in FIG. 3, displays a cross-section in the form of a pair of trapezoids having a common base. To simply obtain good submersion stability it is preferable either to form the bottom surface 9 of the float as concave (which improves stackability) or flat, as previously noted. It has been shown that relatively sharp edges 10 on the bottom surface 9 of the float, offer the most resistance against free sideslipping of the float 1.

It has been shown that a slight tapering of the cross-section of the float, both in plan and side-view, offers the most economical constructively simplest and most robust in practical use solution to achieve the easiest means of excellent linear running stability of the float when "walking" on the water. Both for walking and maneuvering on the water it is necessary that the backward movement resistance of the float is larger than its forward movement resistance. For this purpose, the float is provided with a relatively steep rear wall 11 and a streamlined nose 12.

While the device to take up the foot 2 is shown in FIGS. 2 and 3 simply in the form of a shoe, it is understood that to satisfy the demands made of this device, some measures are necessary which do not form the subject matter of this invention. These relate in particular on the one hand to a stable, firm hold of the foot allowing good freedom of movement and high wearing comfort, and on the other hand the possibility of quickly releasing the foot from the float in case the user falls. It is important thereby, that the sole of the foot lays as deeply as possible to achieve a good center of gravity.

What we claim is:

1. A device for watersports in the form of an elongate float having a fixed substantially flat back surface and a substantially streamlined nose delimiting its length, said back surface being disposed at a relatively steep angle to said length so as to impede the rearward motion of said float, said float having static buoyancy, said float being provided with an attachment to hold a user's foot firmly but releasably, characterized in that (a) the transverse cross-section of the float is of substantially trapezoidal form throughout the length of the float, said trapezoidal form being defined by a pair of trapezoids having sides of different slope and having a common base, said common base being disposed substantially at the mid-water submersion line of said float, with the larger base of said trapezoidal form substantially coinciding with a bottom surface of said float so as to provide sharp edges for said bottom surface and thereby provide resistance to sideslipping, that (b) the cross-section of the float is tapered substantially throughout its length from back to nose at substantially constant tapers both in plan and in side view for optimization of the linear running stability, and that (c) the ratio of the weight of the float to the weight of the displaced water with fully submerged float lies between 0.08 and 0.15.

* * * * *